United States Patent [19]

Eggleston

[11] Patent Number: 4,729,331

[45] Date of Patent: Mar. 8, 1988

[54] LIGHTWEIGHT INFLATABLE SWIM RAFT ANCHOR APPARATUS

[76] Inventor: Cathy Eggleston, 5404 Oleta, Long Beach, Calif. 90815

[21] Appl. No.: 915,054

[22] Filed: Oct. 3, 1986

[51] Int. Cl.[4] ..... B63B 21/00

[52] U.S. Cl. ..... 114/230; 441/130; 114/294

[58] Field of Search ..... 114/293, 294, 230, 311, 114/345; 441/40, 3, 75; 272/1 B

[56] References Cited

U.S. PATENT DOCUMENTS

| | | | |
|---|---|---|---|
| 653,021 | 7/1900 | Hamilton | 114/230 |
| 2,116,880 | 5/1938 | Dee | 114/230 |
| 2,150,420 | 3/1939 | Cooper | 114/345 |
| 2,334,072 | 11/1943 | Cooper | 114/345 |
| 2,370,069 | 2/1945 | Patten | 114/345 |
| 2,381,394 | 8/1945 | Beach, Jr. | 441/3 |
| 2,390,199 | 12/1945 | Walsh | 114/345 |
| 2,456,086 | 12/1948 | Schwall, Jr. | 114/345 |
| 2,589,913 | 3/1952 | Wenner | 114/206 |
| 3,226,114 | 12/1965 | Swider | 114/311 |
| 3,469,844 | 9/1969 | Sindelar | 272/1 B |
| 3,470,845 | 10/1969 | Mignano | 272/1 B |
| 3,724,012 | 4/1973 | Sanderson | 272/1 B |
| 3,935,607 | 2/1976 | Cantwell et al. | 114/345 |
| 3,974,794 | 8/1976 | Karitani et al. | 114/230 |
| 4,479,785 | 10/1984 | Tugwood et al. | 441/75 |

*Primary Examiner*—Sherman D. Basinger
*Assistant Examiner*—Jesûs D. Sotelo
*Attorney, Agent, or Firm*—Fulwider, Patton Rieber, Lee & Utecht

[57] ABSTRACT

A fastener pad formed on one side with an adhesive bond and defining an eye for receipt of a hook. The hook is connected with a suction cup by means of the coiled tether.

7 Claims, 4 Drawing Figures

LIGHTWEIGHT INFLATABLE SWIM RAFT ANCHOR APPARATUS

BACKGROUND OF THE INVENTION

1. Field of the Invention

The present invention relates to a device to be applied to a pneumatic raft for anchoring such raft to the side or bottom of a pool.

2. Description of the Prior Art

With the advent of modern transportation and increased leisure time, tourists at a resort location often seek to relax and sun themselves floating in the resort pool. Typically, a tourist will carry an inflatable raft with him or her to the resort to be assured of having a raft available at the destination. When such rafts are inflated and floated on the surface of the pool, small currents caused by water filtration systems or even the slightest breeze tend to move such rafts about on the surface of the pool and toward the down wind or outflow end of the pool. It is a disrupting and irritating fact that such rafts, when unattended, as for instance when the occupant is fully relaxed or asleep, tend to collect together and bump into one another. Consequently, there exists a need for an anchor which may be utilized to anchor a raft in a predetermined location such that it is restricted from drifting about.

Moreover, since some tourists prefer not to carry their own rafts with them to their resort destination, they will use inflatable rafts supplied by the resort. In those instances, it is desirable to have a compact portable anchor device which may be conveniently and readily attached to the raft to anchor it in position. It is desirable that such anchors be removable and reusable so that they may be removed and taken home by the tourist for subsequent attachment to another raft at a different location.

Other objects and features of the invention will become apparent from consideration of the following description taken in connection with the accompanying drawing.

DESCRIPTION OF THE PREFERRED EMBODIMENT

Figure 1:
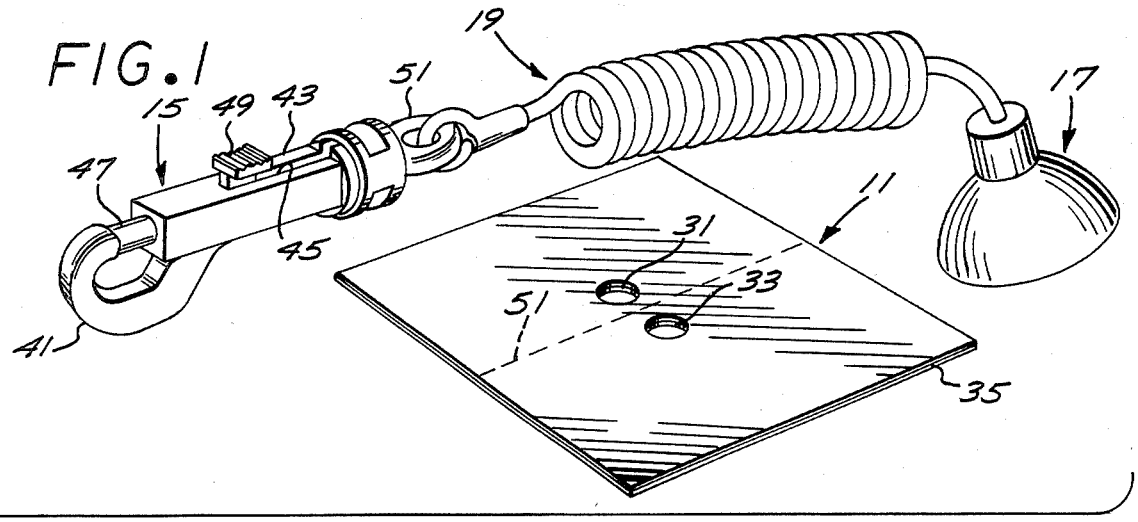
FIG. 1 is a perspective view of a raft anchor apparatus embodying the present invention.
Figure 2:
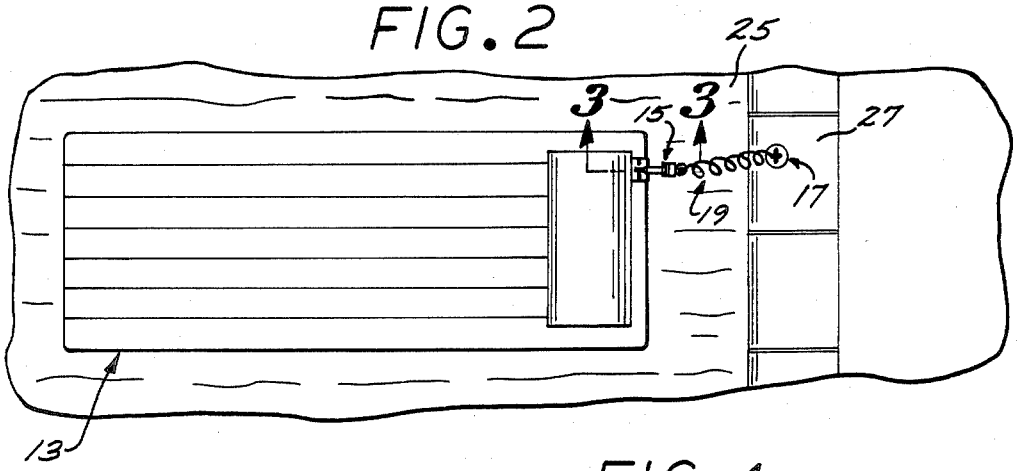
FIG. 2 is a top plan view, in reduced scale, showing the raft anchor apparatus of FIG. 1 applied to a raft.
Figure 3:
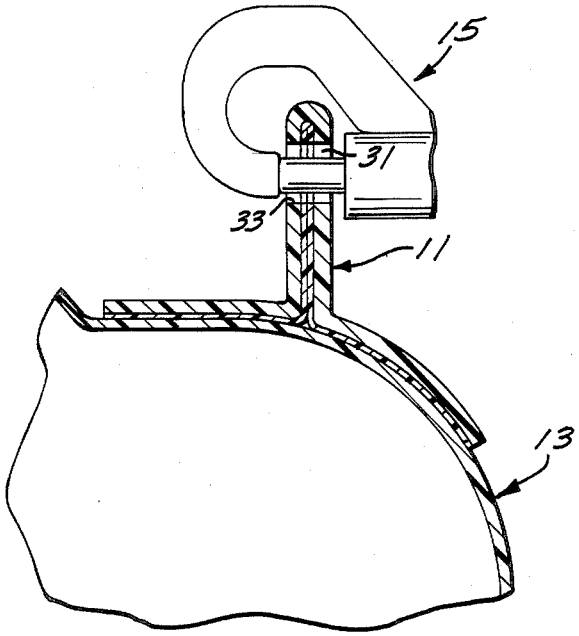
FIG. 3 is a vertical sectional view, in enlarged scale, taken along the line 3—3 of FIG. 2.

Referring to FIGS. 1 and 3, the pneumatic raft apparatus of the present invention includes, generally, a flexible plastic square defining a fastener 11 for attachment to a raft 13. A snap 15 hooks to the fastener shown in FIG. 3 and is tethered to a small suction cup 17 by means of a coil tether 19.

Conventional rafts 13 are typically constructed of plastic and may be inflated to float on the surface of a pool 25. The border of a pool is frequently formed by tile 27 which is a convenient anchor spot for the suction cup 17.

For convenience in storage, transporting and use, the snap 15, coil tether 19 and suction cup 17 may be all constructed of plastic. The fastener pad 11 may also be constructed of plastic and the preferred embodiment consists of a plastic square having a pair of bores 31 and 33 formed in spaced apart relation on opposite sides of the centerline 51. A pressure sensitive adhesive is applied to one side of the plastic square and is covered by conventional backing sheet 35.

The snap 15 is formed with a hook end 41 and hollow shank 43 formed on one side with a slot 45. Received in the hollow shank 43 is a cylindrical plunger rod 47 having a thumb plate 49 formed therewith and projecting through the slot 45. The plunger rod 47 is biased toward its closed position shown in FIGS. 1 and 3 by means of a coil spring (not shown). Formed on the opposite end of the hook is a eye 51 connected with one end of the coil tether 19. The tether 19 is constructed of plastic having a memory such that it tends to remain coiled but can be stretched to a elongated position. The suction cup 17 is connected to the opposite end of the tether coil 19.

In operation, when the tourist desiring to relax or sunbathe on the pool surface has inflated the pneumatic raft 13, the fastener 11 may be applied thereto. Conveniently, the protector sheet 35 may be removed and the strip defining the pad 11 bent over centrally along the center line 51 (FIG. 1) with the bores 31 and 33 in alignment and the opposed central portions bonded together to form an upstanding flange (FIG. 3). Care should be taken to avoid the end portions of the strip square remote from the center line 51 coming into contact with one another. With the square so folded over the remote end portions thereof may be secured to the surface of the raft 13 as shown in FIG. 3 to thus provide the desired bonding to the raft itself.

The snap 15 may then be snapped into the eye formed by the aligned bores 31 and 33 (FIG. 3) and the raft 13 maneuvered into a position adjacent the pool edge. The suction cup 17 may then be plunged against the tile 27 to anchor the raft securely in position. From time to time, as the sun progresses across the sky causing shadows to change position or as the sunbather seeks a different degree of sun, the suction cup 17 may be removed, the raft 13 relocated, and the suction cup again secured to the side of the pool to reanchor the raft.

Should the raft 13 be a borrowed raft from the resort, when it is turned in at night, the hook 15 may be removed so the tourist may keep it in a secure place overnight for use again the next day with the same raft or another raft having a different anchor pad 11 attached thereto. Likewise, when the tourist's stay at the resort is completed, the anchor apparatus may be maintained in his or her possession for use on a subsequent outing.

Figure 4:
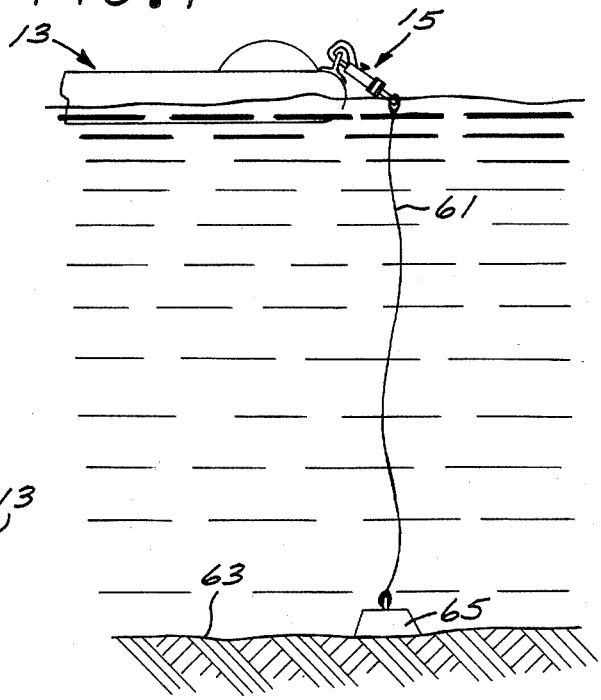
FIG. 4 is an elevational view of a second embodiment of the raft anchor apparatus of the present invention, in enlarged scale, showing the raft anchor apparatus of FIG. 2 in use.

The embodiment of the pneumatic raft anchor apparatus shown in FIG. 4 is similar to that shown in FIG. 1 except that it incorporates a tether cord 61 having a length sufficient to reach the bottom 63 of the pool. Fixed to the remote end of the tether cord 61 is a small weight defining an anchor 65 which is held against the pool bottom 63 by gravity, thus anchoring the raft 13 in position. It will be appreciated that the raft anchor apparatus shown in FIG. 4 operates substantially the same as that for the anchor apparatus shown in FIG. 1 except that the anchor 65 itself will typically rest on the pool bottom to anchor the raft 13 in position.

Other modifications and changes may be made with regard to the foregoing detailed description without departing from the spirit of the invention.

I claim:

1. An anchor apparatus for attachment to a prefabricated, light weight, inflatable, swim raft for anchoring same in a swimming pool and comprising:

a fastener device for attachment to the surface of such prefabricated swim raft and including a mounting pad formed with one side for attachment to such raft surface, such device being further formed with an eye;

pressure sensitive adhesive bonding means on said one side of said mounting pad for rapidly bonding said mounting pad on said raft;

a backing sheet temporarily covering said bonding means and releasable to expose said bonding means;

a manually releasable hook for hooking into said eye; anchor means; and a tether connected between said hook and anchor means whereby said anchor apparatus may be transported to a site of use, said backing sheet removed from said mounting pad and said pad bonded to said surface of said swim raft such that said hook may be connected to said eye to enable said anchor to be deployed to anchor such swim raft in such pool during use.

2. An anchor apparatus as set forth in claim 1 wherein:

said fastener is in the form of a plastic patch and is further formed with a bore defining said eye.

3. An anchor apparatus as set forth in claim 2 wherein:

said plastic patch is in the form of a strip formed with a pair of bores spaced equidistant on the opposite sides of the center line thereof such that the central portion of said strip, when folded over on said center adheres together to form an upright flange and align said bores, and the end portions of said strip flared outwardly away from said folded back portion to form feet defining said one side.

4. An anchor apparatus as set forth in claim 1 wherein:

said anchor means includes a suction cup.

5. An anchor apparatus as set forth in claim 1 wherein:

said anchor means includes a weight.

6. An anchor apparatus as set forth in claim 1 wherein:

said tether includes an elongated member formed in a coil having a memory tending to maintain it in a tight coil but being extendable under relatively small loads.

7. An anchor apparatus as set forth in claim 1 wherein:

said hook includes a closure.

* * * * *